US005950050A

United States Patent [19]

Shirasaki et al.

[11] Patent Number: 5,950,050

[45] Date of Patent: Sep. 7, 1999

[54] IMAGE FORMING APPARATUS

[75] Inventors: Seiichi Shirasaki; Toshiyuki Hamada; Kenji Oda; Shuichi Akedo; Tadahiro Kiyosumi, all of Osaka, Japan

[73] Assignee: Mita Industrial Co., Ltd., Osaka-fu, Japan

[21] Appl. No.: 09/233,634

[22] Filed: Jan. 19, 1999

[30] Foreign Application Priority Data

Jan. 19, 1998 [JP] Japan ..... 10-007962
Jan. 19, 1998 [JP] Japan ..... 10-007964

[51] Int. Cl.[6] ..... G03G 15/20

[52] U.S. Cl. ..... 399/124

[58] Field of Search ..... 399/21, 125, 124, 399/403, 404, 405, 407; 270/58.08, 58.11

[56] References Cited

U.S. PATENT DOCUMENTS 5,839,032 11/1998 Yasui et al. ..... 399/124

*Primary Examiner*—Arthur T. Grimley
*Assistant Examiner*—Greg Moldafsky
*Attorney, Agent, or Firm*—Jordan and Hamburg LLP

[57] ABSTRACT

In an image forming apparatus, a sheet that has been transported in a certain direction is selectively transported to one of first and second transport routes by a route changer mechanism. A first cover and a second cover are openably provided on a main body of the apparatus to respectively allow the first and second transport routes to be accessible to outside of the apparatus main body when set in an opened state. An operative mechanism is provided to open the first cover in association with opening of the second cover.

12 Claims, 5 Drawing Sheets

IMAGE FORMING APPARATUS

BACKGROUND OF THE INVENTION

This invention relates to image forming apparatuses such as copiers and printers in which a plurality of sheet transport routes are provided to transport a sheet toward a destination of a plurality of destinations different from each other and the respective transport routes are exposed outside of a main body of the apparatus by opening a cover individually provided in correspondence to the transport routes.

A construction of an image forming apparatus as shown in FIG. 5 is known in which a sheet after an image transfer is transported along a certain transport route of a plurality of transport routes and discharged outside a main body of the apparatus.

FIG. 5 is a partially enlarged diagram of the construction. In FIG. 5, 302 is an imaging unit of the apparatus. The imaging unit 302 includes a photoreceptor 300 and a transfer roller 301. An image transfer is performed by the imaging unit 302.

Specifically, an electrostatic latent image is formed on an outer circumference of the photoreceptor 300 based on an image read from a document. By electrically attracting charged toner onto the latent image, the latent image is developed into a toner image on the surface of the photoreceptor 300. The toner image on the photoreceptor surface is electrically attracted to a copy sheet transported to the photoreceptor 300 due to a transfer voltage applied between the photoreceptor 300 and the transfer roller 301 to transfer the toner image onto the copy sheet. In this way, the toner image is transferred onto the sheet.

Fixing rollers 303, 303 are arranged downstream of the imaging unit 302 with respect to the sheet transport direction (indicated by the upward-directing arrow in FIG. 5). After passing the imaging unit 302, the sheet has the toner image fixed thereon by the fixing rollers 303, 303 while being applied with a heat.

A transport route formed downstream of the fixing rollers 303, 303 is branched into a transport route 305 communicating with a discharge port 307 and a transport route 304 communicating with a discharge port 308 opposite to the discharge port 307. A sheet after an image fixation is selectively transported either along the transport route 304 or the transport route 305 by a route changer mechanism.

Specifically, switching members 306, 306 as the route changer mechanism are provided at the junction of the transport routes 304, 305. The switching members 306, 306 are pivotable about respective axes of pivots to selectively guide a sheet after an image fixation to the transport route 304 and the transport route 305. When the switching members 306, 306 are set in a state shown by the solid line in FIG. 5, the sheet is transported toward the transport route 305 while guided along the track indicated by the bold solid line P in FIG. 5 and discharged onto a discharge tray 313 via the discharge port 307. In this case, the sheet is discharged onto the discharge tray 313 with the side carrying an image facing downward.

On the other hand, when the switching members 306, 306 are set in a state shown by the dashed line in FIG. 5, the sheet is transported toward the transport route 304 and discharged onto a finisher (not shown) or a discharge tray (not shown) with the side carrying an image facing upward.

Also, when the switching members 306, 306 are set in the dashed-line state in FIG. 5 to guide a sheet along the transport route 304, the transport routes 304, 305 are communicated to each other. Accordingly, in this state, the transport routes 304, 305 function as a switchback route to guide a sheet toward the discharge port 308 along the track indicated by the broken line P' in FIG. 5 by performing the following operations.

Specifically, first, the switching members 306, 306 are set in the solid-line state to temporarily transport a sheet toward the discharge port 307. When a tail end of the sheet in the transport direction reaches a certain position between a discharge roller pair 309, 309 provided near the discharge port 307 and the switching member 306, the discharge roller 309 is driven in a reverse direction. At this time, changing the posture of the switching members 306, 306 to the dashed-line state allows the sheet to be transported toward the discharge port 304 along the transport routes 305, 304.

More specifically, in the above state when the switchback route is provided by the transport routes 304, 305, connecting the transport route 304 to an access route (not shown) via the discharge port 308 and connecting the access route to the imaging unit 302 enables a double sided image transfer by feeding the sheet after a first image transfer again to the imaging unit 302 while utilizing the switchback route and the access route. The access route connecting the transport route 304 and the imaging unit 302 may be provided by mounting an external device on a side wall of the apparatus main body, e.g., a side wall of the apparatus on the same side as a cover 310 in which the discharge port 308 is formed.

The cover 310 is openably mounted on the side wall of the apparatus, and opening the cover 310 renders the transport route 304 accessible to outside of a main body of the apparatus. Likewise, a cover 311 is openably mounted on a top portion of the apparatus near the discharge port 307. Opening the cover 311 renders the transport route 305 accessible to outside of the main body of the apparatus. Opening the cover 310 (311) enables removing a jammed sheet in the transport route 304 (305) and maintenance service of the transport route 304 (305).

In the above apparatus, in the case where a sheet is jammed inside the apparatus main body near the switching member 306, an operator has a difficulty in judging which cover should be opened to remove the jammed sheet. Accordingly, what happened for most cases is that the operator at randomly opens the cover 310 (or 311) trying to confirm the position of the jammed sheet. When the operator judges it easier, after the trial opening, to remove the jammed sheet by opening the other cover 311 (or 310), he/she has to open the other cover 311 (or 310) in addition to the opening of the cover 310 (or 311). This operation is time-consuming and cumbersome.

Also, it is sometimes the case that merely opening one of the covers 310, 311 does not allow the operator to properly judge the position of the jammed sheet, thereby deterring the removal of the jammed sheet.

In view thereof, there is a demand for an image forming apparatus with an improved serviceability such as quick removal of jammed sheet and easy maintenance service.

SUMMARY OF THE INVENTION

In view thereof, it is an object of the present invention to provide an image forming apparatus having an improved serviceability such as quick removal of a jammed sheet and easy maintenance service.

To fulfill the above object, an image forming apparatus, according to an aspect of this invention, comprises: a main body; a first transport route for guiding a sheet that has been transported in a certain direction and a second transport route for guiding the sheet in another direction different from the certain direction; a route changer for selectively changing the transport route between the first transport route and the second transport route; a first cover and a second cover openably mounted on the main body to respectively render the first transport route and the second transport route accessible to outside of the main body when set in an opened state; and an operative mechanism for opening the first cover in association with opening of the second cover.

These and other objects, features and advantages of the present invention will become more apparent upon reading of the following detailed description and accompanying drawings.

DETAILED DESCRIPTION OF THE INVENTION

Hereinafter, an embodiment of this invention is described with reference to the accompanying drawings.

Figure 1:
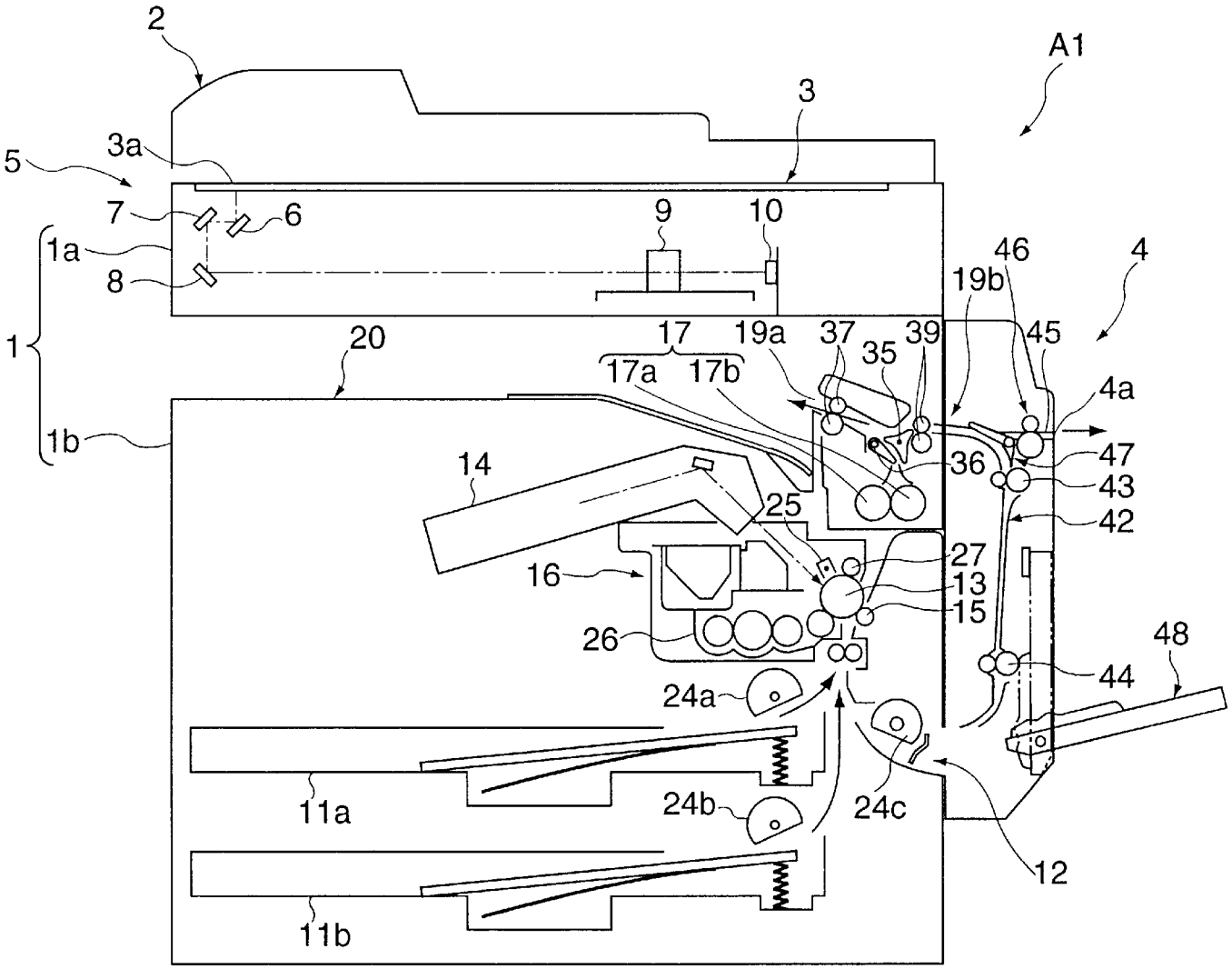
FIG. 1 is an overall schematic constructional diagram of a copying machine as an embodiment of an image forming apparatus of this invention.

FIG. 1 is a schematic diagram showing an overall construction of a copying machine A1 as an embodiment of an image forming apparatus according to this invention. The copying machine A1 comprises a main body 1, an automatic reversible document feeder 2 (hereinafter, merely referred to as "RADF 2") mounted on a top portion of the main body 1, and a double-sided copying transport unit 4 (hereinafter, referred to as "DSC transport unit 4") mounted on a side wall of the main body 1.

The machine main body 1 includes an image reading section 1*a* for reading an image of a document, and an image forming section 1*b* for forming the image read by the image reading section 1*a* on a copy sheet. The image reading section 1*a* is arranged above the image forming section 1*b* by an appropriate spacing. A sheet discharge portion 20 is provided in the spacing.

The RADF 2 is provided at an upper portion of the image reading section 1*a*. The RADF 2 is so constructed as to automatically transport a set of documents placed thereon successively onto an image reading area 3*a* of a document setting portion 3 provided on the image reading section 1*a* and discharge the set of documents successively thereon after an image reading.

The image reading section 1*a* includes an image reading optic system 5 for scanning an image on a document that is placed on the document setting portion 3 or fed to the image reading area 3*a* by the RADF 2. The image reading optic system 5 receives light reflected from the document.

The image reading optic system 5 includes a fluorescent lamp (not shown), mirrors 6, 7, 8, a lens 9, and a line sensor 10. When the document surface is illuminated by the fluorescent lamp, the light reflected from the document surface is guided to the line sensor 10 via the mirrors 6, 7, 8 and through the lens 9. Each time the document is transported onto the image reading area 3*a*, the optic system 5 is activated to scan the document image.

In case of placing a document such as a bulky book and the like on the document setting portion 3 to copy the image of the document, the fluorescent lamp and the mirrors 6, 7, 8 are moved from left to right in FIG. 1 without activating the RADF 2, thereby scanning the document image.

The image forming section 1*b* includes sheet cassettes 11*a*, 11*b* for accommodating copy sheets therein, a manual insertion inlet 12 through which a sheet is manually inserted from outside of the machine main body 1, a laser optic system 14 for irradiating laser beams of a level corresponding to a level inputted to the line sensor 10, an imaging assembly 16 for forming a toner image to transfer the toner image onto a copy sheet fed from the sheet cassette 11*a* (11*b*) or through the manual insertion inlet 12, a fixing roller pair 17 for fixing the transferred toner image on the copy sheet, discharge ports 19*a*, 19*b* for discharging the sheet after the image fixation by the fixing roller pair 17, a route changer mechanism for changing the transport route for the sheet after the image fixation, the sheet discharge portion 20 on which the sheet is stacked via the discharge port 19*a*, and transport means for transporting the sheet in a certain direction in accordance with a predetermined transport procedure.

The imaging assembly 16 includes a photoreceptor 13 for forming an electrostatic latent image on a surface thereof by a laser beam irradiated from the laser optic system 14. The imaging assembly 16 further includes a charger 25, a developer 26, a transfer roller 15, and a cleaning roller 27 in a periphery of the photoreceptor 13. The charger 25 charges the surface of the photoreceptor 13 at a predetermined potential. The developer 26 develops a latent image into a toner image. The transfer roller 15 transfers the toner image onto a copy sheet. The cleaning roller 27 removes toner residues on the surface of the photoreceptor 13.

The fixing roller pair 17 consists of a heater roller 17*a* and a presser roller 17*b* which is pressed against the heater roller 17*a*. After an image formation by the imaging assembly 16, the sheet is transported between the heater roller 17*a* and the presser roller 17*b*. While passing between the heater roller 17*a* and the presser roller 17*b*, the sheet is applied with a heat of about 180° C. while pressed against the presser roller 17*b* to thereby fix the toner image onto the sheet.

Figure 2:
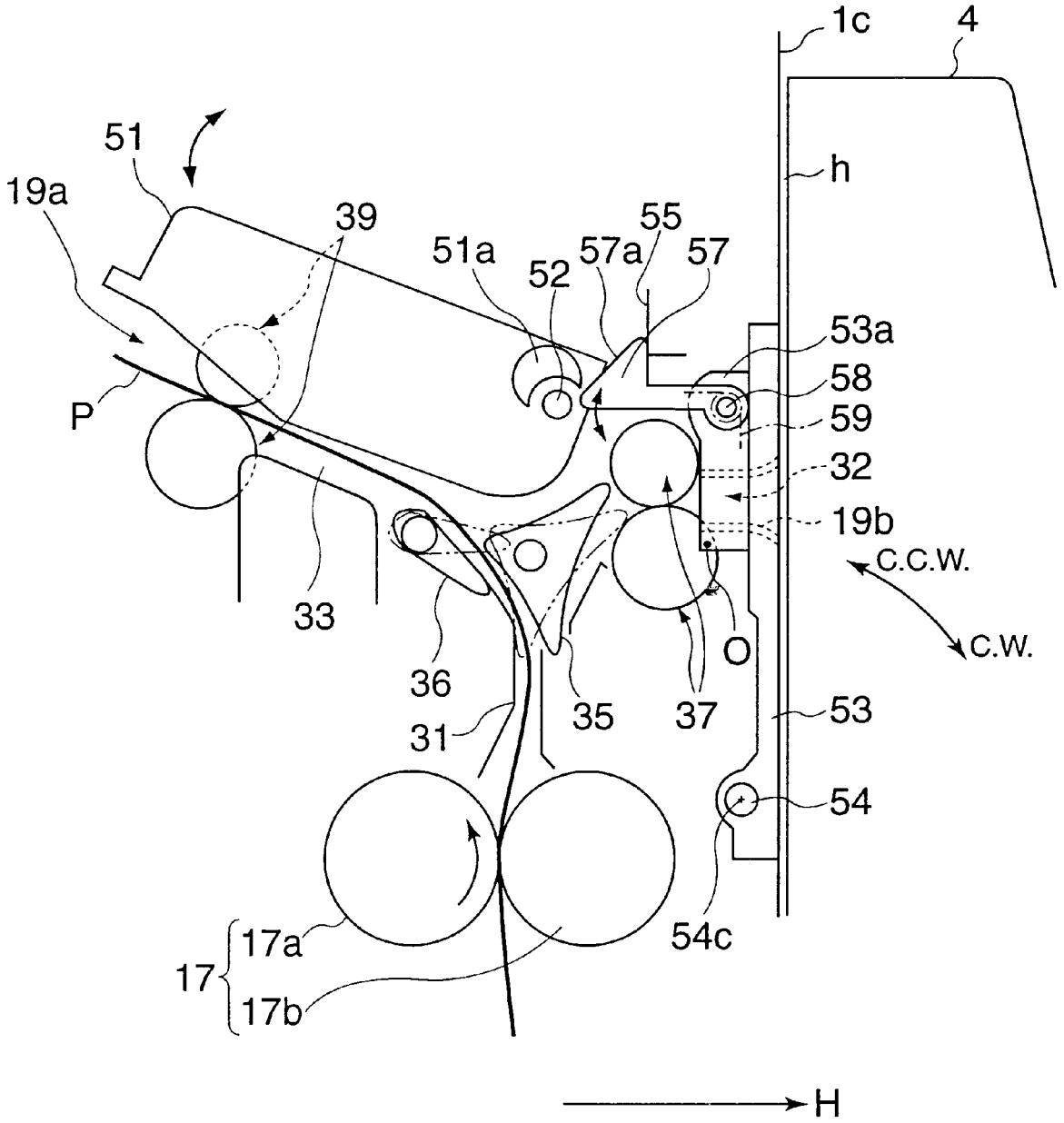
FIG. 2 is a partially enlarged view showing a state of fixing rollers, switching members and its periphery in the copying machine when a second cover is set in a closed state in the case where a double-sided copying transport unit is mounted on a main body of the copying machine.

As shown in FIG. 2, a main route 31 for transporting a sheet after an image fixation is provided downstream of the fixing roller pair 17 with respect to the sheet transport direction shown by the upward-directing arrow in FIG. 2. The main route 31 is branched into a first route 32 (first transport route) for guiding the sheet toward the discharge port 19*b* and a second route 33 (second transport route) extending in a direction different from the extending direction of the first route 32 (upwardly leftward direction in FIG. 2) to guide the sheet to the discharge port 19*a*. Discharge roller pairs 37, 39 are arranged on the first and second routes 32, 33 near the discharge ports 19*b*, 19*a*, respectively. The route changer mechanism is provided at a junction of the main route 31 at which the first route 32 and the second route 33 intersect with each other.

As shown in FIG. 2, the route changer mechanism includes switching members 35, 36 which are pivotable about respective axes of pivots in association with each other to change the transport route for the sheet. The switching members 35, 36 are pivotable to change its posture between a first state (shown by the broken line in FIG. 2) to guide the sheet after the fixing roller pair 17 along the first route 32 and a second state (shown by the solid line in FIG. 2) to guide the sheet along the second route 33.

More specifically, when the switching members 35, 36 are set in the first state, the sheet is guided along the first route 32 and discharged outside the machine main body 1 through the discharge port 19*b* by the discharge roller pair 37.

On the other hand, when the switching members 35, 36 are set in the second state, the sheet is transported along the second route 33 and discharged onto the discharge portion 20 through the discharge port 19*a* by the discharge roller pair 39 (namely, along the track shown by the solid line P in FIG. 2).

The first route 32 is communicated with the second route 33 when the switching members 35, 36 are set in the first state. To connect the first route 32 with the second route 33, the switching members 35, 36 are set in the second state to temporarily transport the sheet in the direction toward the discharge port 19*a*, and then, the rotation of the discharge roller 39 is reversed when a tail end of the sheet with respect to the transport direction reaches a certain position between the discharge roller pair 39 and the switching member 36. Spontaneously with the reverse rotation of the discharge roller 39, the switching members 35, 36 are set in the first state. Thereby, the sheet is transported in the direction toward the discharge port 19*b* opposite to the transport direction toward the discharge port 19*a*. In this way, changing the state of the switching members 35, 36 in association with the reverse rotation of the discharge roller 39 enables a switchback operation of the sheet.

A cover 51 (second cover) is openably mounted at a top portion of the machine main body 1 above the switching members 35, 36. The cover 51 constitutes an upper wall of the second route 33 when closing the top portion of the machine main body 1. The upper roller of the discharge roller pair 39 is rotatably supported on the cover 51. The cover 51 is pivotable about an axis of a pivot shaft 52 which is provided on the machine main body 1. The cover 51 is so constructed as to define the second route 33 when shifted to a closed state (see FIG. 2) and expose the inside of the second route 33 outside the machine main body 1 when shifted to an opened state (see FIG. 4).

A cover 53 (first cover) is openably mounted on a side wall of the machine main body 1 on the side of the discharge roller pair 37. The discharge port 19*b* is formed in the cover 53. The cover 53 is pivotable about an axis of a pivot shaft 54 (horizontal shaft) provided on the machine main body 1, and is so constructed as to cause the discharge port 19*b* to communicate with inside of the first route 32 when shifted to a closed state and expose the inside of the first route 32 outside the machine main body 1 when shifted to an opened state. The cover 53 constitutes part of a side wall 1*c* of the machine main body 1 on which the DSC transport unit 4 is mounted. The cover 53 is allowed to be set in a fully opened state when the DSC transport unit 4 is not mounted on the machine main body 1 to expose the inside of the first route 32 to outside of the machine main body 1.

A hook 57 is provided at an upper portion of the cover 53 extending inward of the machine main body 1. The hook 57 is operated such that engaging with an engaged portion 55 provided in the machine main body 1 locks a closed state of the cover 53. Specifically, a flange 53*a* is provided at the upper portion of the cover 53. A pivot shaft 58 is mounted on the flange 53*a*. The hook 57 is pivotally provided on the flange 53*a* via pivot shaft 58. The hook 57 is biased in a certain direction (clockwise direction in FIG. 2) by a torsion spring 59 (bias member) wound around the pivot shaft 58.

With this arrangement, unless an external force is applied to open up the cover 51, the hook 57 is engaged with the engaged portion 55 due to a biasing force of the torsion spring 59 acting upon the hook 57 in the clockwise direction (see FIG. 2) to hold a closed state of the cover 53. On the other hand, when an external force is applied to the cover 51 to open up the cover 51, the hook 57 is rotated downward in the counterclockwise direction (see FIG. 2) against the biasing force of the torsion spring 59 and disengaged from the engaged portion 55, thereby releasing the locked state of the cover 53. In this way, the cover 53 is allowed to be opened.

Figure 3:
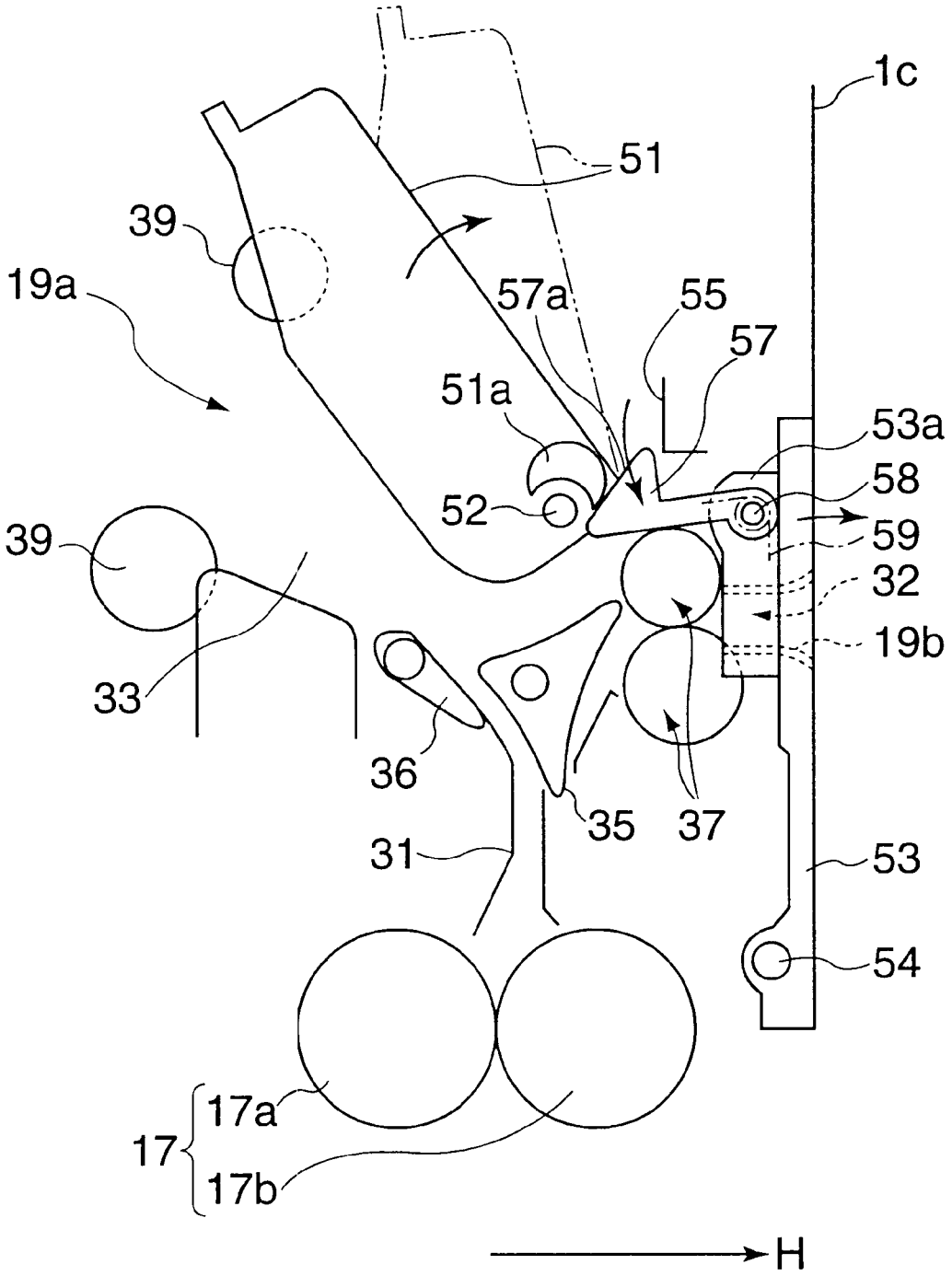
FIG. 3 is a partially enlarged view showing a state of the fixing rollers, the switching members and its periphery when the second cover is being shifted to an opened state in the case where the double-sided copying transport unit is not mounted on the machine main body.
Figure 4:
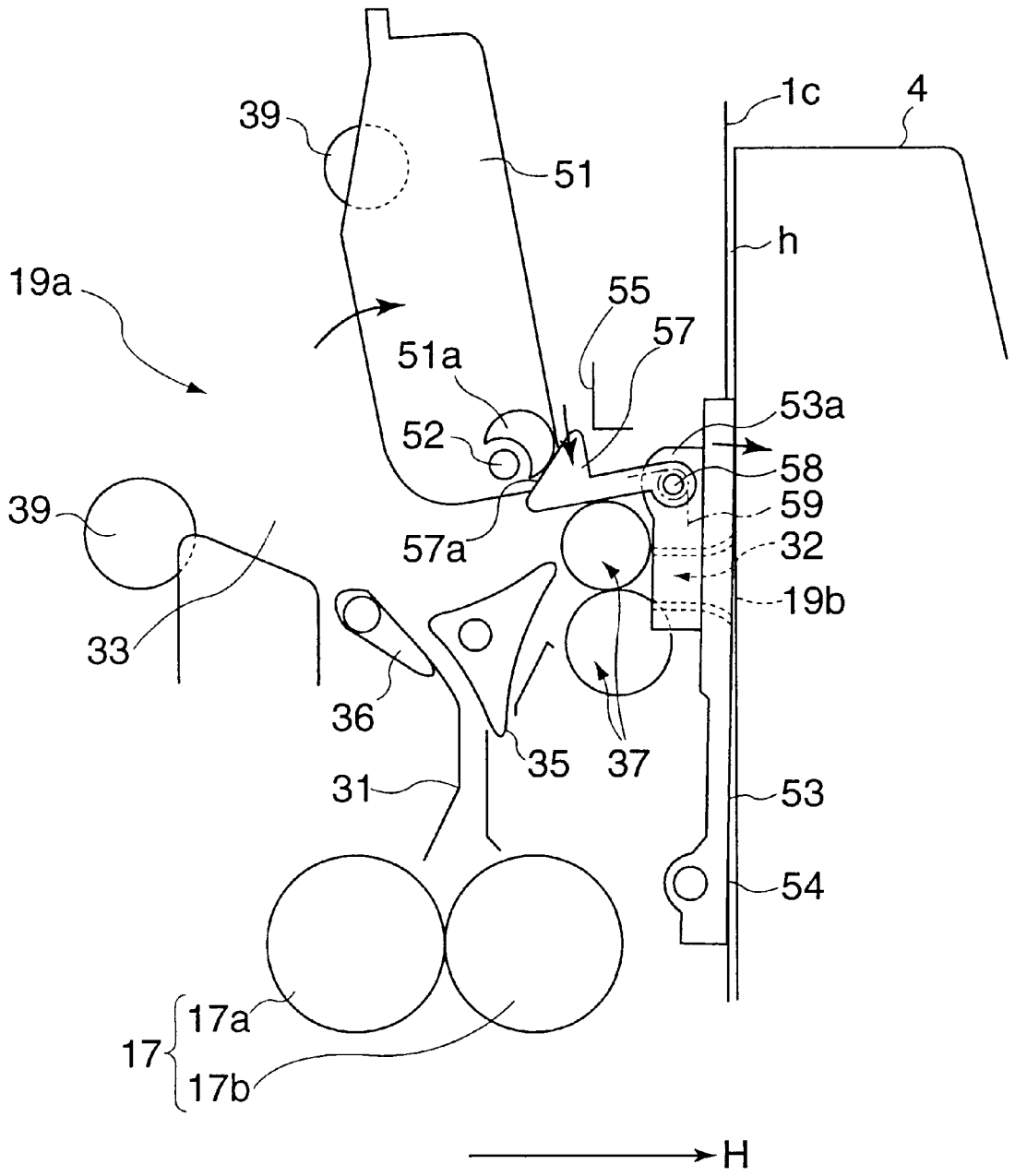
FIG. 4 is a partially enlarged view showing a state of the fixing rollers, the switching members and its periphery when the second cover is set in an opened state in the case where the double-sided copying transport unit is mounted on the machine main body.
Figure 5:
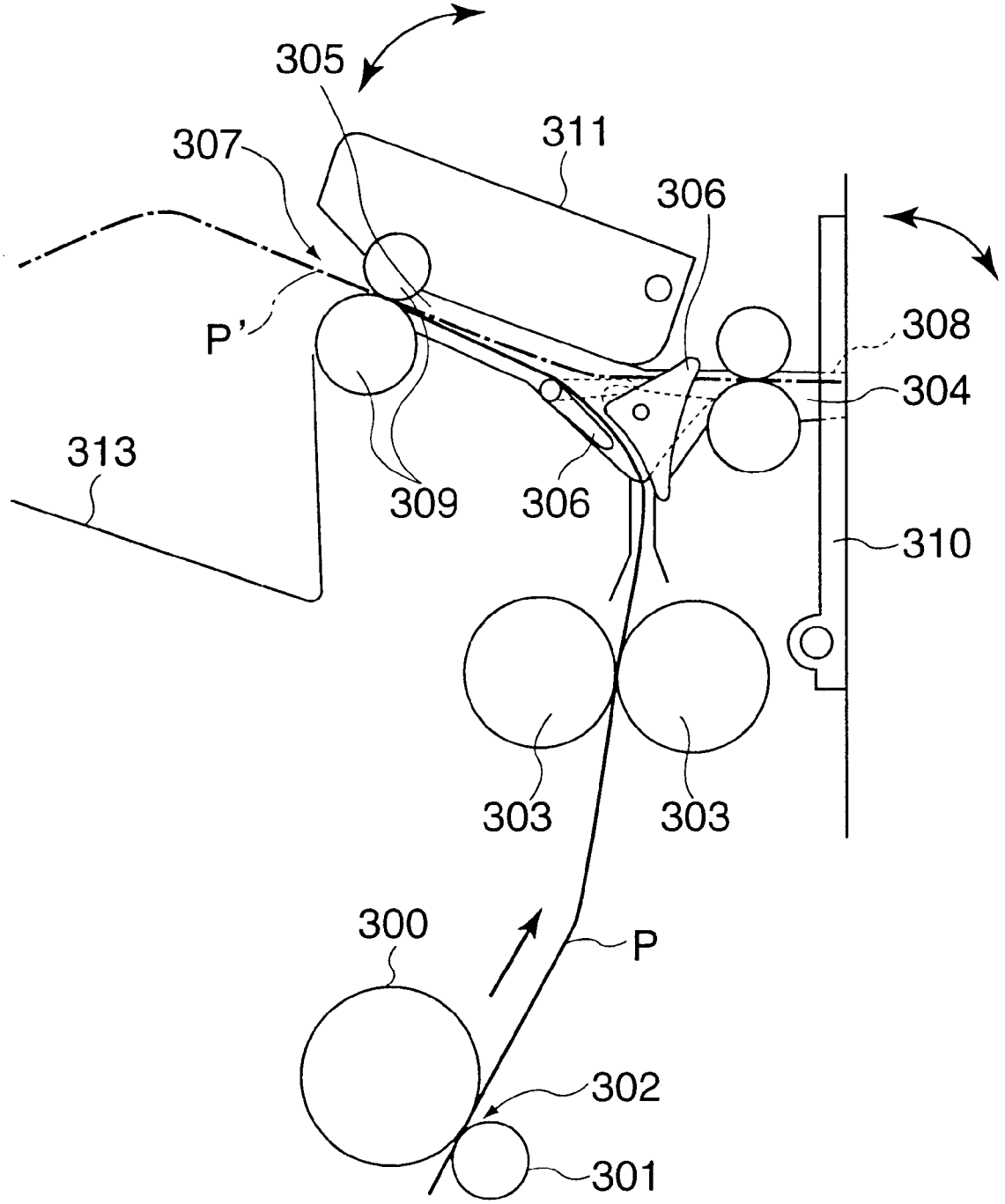
FIG. 5 (PRIOR ART)
FIG. 5 is a partially enlarged view of a fixing unit, switching members and its periphery in an image forming apparatus of prior art.

Disengagement of the hook 57 from the engaged portion 55 may be performed by operating a handle (not shown) provided on the cover 53. In addition, in this embodiment, the disengagement is also performed in association with opening of the cover 51. Specifically, a projection 51*a* having a crescent-moon shape when viewed from the plane of FIGS. 2 to 4 is provided on the cover 51 near the pivot shaft 52. As shown in FIG. 3, when the cover 51 is being opened (shifted from the solid-line state to the broken-line state), the projection 51*a* is pressed against the hook 57 to rotate the hook 57 downward in the counterclockwise direction about the axis of the pivot shaft 58.

A contact portion 57*a* of the hook 57 in contact with the projection 51*a* has a tapered downward slope (so-called "wedge-shape" viewed from the plane of FIGS. 2 to 4) as approaching toward the cover 51. When the cover 51 is opened, a pressing force of the projection 51*a* acting on the hook 57 has certainly a force component to shift the cover 53 toward an opened direction (shown by the rightward-directing arrow in FIG. 3). Note that the biasing force of the torsion spring 59 is adequately set because if the bias force is so weak then the hook 57 simply rotates in counterclockwise direction when the contact portion 57*a* is pressed by the projection 51*a*, not enough torque is delivered to the cover 53 to rotate in the clockwise direction. Accordingly, when the contact portion 57*a* is pressed downward by the projection 51*a*, the cover 53 is tilted from the side wall 1*c* by a predetermined angle. After tilted by the predetermined angle, the cover 53 is pivotally openable about the axis of the pivot shaft 54 by the weight thereof, that now gives a moment in clockwise direction around the axis 54*c* of the shaft 54, and shifted to a completely opened state.

To sum up the above, the hook 57 and the engaged portion 55 constitute locking means, and the projection 51*a* constitutes lock releasing means. The locking means and the lock releasing means constitute an operative mechanism which activates an opening of the cover 53 in association with an opening of the cover 51.

More specifically, as shown in FIG. 2, when the cover 53 is set in a completely closed state, the cover 53 has a center of gravity 0 at a certain point on the flange 32, namely, inside the machine main body 1 from the pivot shaft 54. When the cover 53 is opened from the side wall 1*c* beyond the predetermined angle accompanied with an opening of the cover 51, the center of gravity 0 is shifted to a position outside of the machine main body 1 from the pivot shaft 54.

Thereby, when the cover 53 is tilted rightward from the state of FIG. 3 beyond the predetermined angle accompanied by the opening of the cover 51, the cover 53 is opened by the weight thereof because the center of gravity of the cover 53 is shifted from the initial point 0 (see FIG. 2) to the outside of the machine main body 1 when the opened angle of the cover 53 exceeds the predetermined angle.

The predetermined angle is set wider than a maximum angle at which the cover 53 can be tilted within a clearance h defined between the side wall 1*c* and the DSC transport unit 4 (see FIGS. 2 and 4). Specifically, as shown in FIG. 2, the center of gravity 0 of the cover 53 is set inwardly of the machine main body 1 from the pivot shaft 54 along the horizontal direction H, as long as the cover 53 is opened within the clearance h in association with an opening of the cover 51.

As shown in FIG. 1, the DSC transport unit 4 is internally provided with a U-turn route 42 (sheet circulating route) for guiding a sheet discharged outside of the machine main body 1 through the discharge port 19*b* to the manual insertion inlet 12, and a pair of transport rollers 43, 44 for transporting the sheet along the U-turn route 42. Guiding the sheet discharged out of the machine main body 1 again to the imaging assembly 16 enables a joint copying and a double-sided copying which are described later.

Referring back to FIG. 1, a discharge route 45 extends at an upper portion of the DSC transport unit 4 from a junction of the U-turn route 42 at which the discharge route 45 intersects to a discharge port 4*a* formed in a side wall of the DSC transport unit 4. A discharge roller pair 46 is provided along the discharge route 45. A switching member 47 is provided at the junction of the discharge route 45 and the U-turn route 42, and is pivotable about an axis of a pivot to change its posture between a state to enable guiding the sheet discharged out of the machine main body 1 through the discharge port 19*b* toward the manual insertion inlet 12 via the U-turn route 42 and a state to guide the sheet toward the discharge port 4*a* along the discharge route 45.

A manual insertion tray 48 is provided at lower part of the DSC transport unit 4. Stacking a set of sheets on the manual insertion tray 48 enables supplying the sheets from outside the machine main body 1 through the manual insertion inlet 12.

A sheet dispensed from the sheet cassette 11*a* (11*b*) or fed from the manual insertion tray 48 is fed to the imaging assembly 16 by a feed roller 24*a* (24*b*) provided at a lead end (right side in FIG. 1) of the cassette 11*a* (11*b*) or a feed roller 24*c* arranged near the manual insertion inlet 12.

Returning to an image forming operation in the imaging assembly 16, the surface of the photoreceptor 13 is uniformly charged by the charger 25, a laser beam is irradiated by the laser optic system 14 to expose a certain area of the surface of the photoreceptor 13, thereby forming an electrostatic latent image on the surface of the photoreceptor 13. While the latent image is developed into a toner image by the developer 26, the sheet dispensed from the sheet cassette 11*a* (11*b*) or fed through the manual insertion inlet 12 is transported between the photoreceptor 13 and the transfer roller 15 to transfer the toner image onto the sheet.

After passing the developer 26, the sheet is transported to the fixing roller pair 17. Thereafter, the sheet is transported either along the first route 32 or the second route 33 by a switching operation of the switching members 35, 36.

More specifically, when the switching members 35, 36 are set in the second state, the sheet is discharged onto the discharge portion 20 via the second route 33. At this time, the sheet is discharged on the discharge portion 20 with the side carrying the transferred image facing downward.

On the other hand, when the switching members 35, 36 are set in the first state, the sheet is allowed to be discharged in the DSC transport unit 4 while flipped over along the first route 32 and the U-turn route 42. When the sheet is fed to the imaging assembly 16 again via the U-turn route 42 and the manual insertion inlet 32, the side carrying the transferred image opposes to the photoreceptor 13. Thereby, a joint copying is enabled in which an image is jointly transferred on a non-image area of the surface of the sheet carrying an image.

In the case where the switching members 35, 36 are set in the first state and the sheet is discharged out of the DSC transport unit 4 along the discharge route 45 through the discharge port 4*a*, the sheet is discharged on a discharge tray (not shown) with the side carrying the transferred image facing upward.

In the case where the sheet is transported in the DSC transport unit 4 by a switchback operation along the second route 33 and the first route 32 and fed to the imaging assembly 16 again via the U-turn route 42 and the manual insertion inlet 12, the sheet is fed to the imaging assembly 16 this time in a state that the side carrying the transferred image opposes to the transfer roller 15. Thereby, when the sheet is transported to the imaging assembly 16 again, an image is transferred on the opposite side of the sheet. In this way, a double side copying is performed.

In the case where the DSC transport unit 4 is not mounted on the machine main body 1, namely in case of one side copying, a sheet dispensed from the sheet cassette 11*a* (11*b*) or fed through the manual insertion inlet 12 has an image transferred and fixed on one side thereof by the imaging unit 16 and the fixing roller pair 17 and discharged on the discharge portion 20 via the discharge port 19*a* in a state that the side carrying the transferred image faces downward or discharged on the discharge tray (not shown) via the discharge port 19*b* in a state that the side carrying the transferred image faces upward.

In the copying machine A1, there cannot be avoided a possibility that a sheet may be jammed in the first route 32, the second route 33, or while passing between or after the fixing roller pair 17. In such a case, the cover 51 (53) should be opened to remove the jammed sheet.

As mentioned above, the copying machine A1 is constructed such that the cover 53 which is accessible to the first route 32 is opened in association with an opening of the cover 51 which is accessible to the second route 33. Opening the cover 51 causes the projection 51*a* in pressing contact with the hook 57 to pivotally rotate the hook 57 downward in the counterclockwise direction about the axis of the pivot shaft 58. Accompanied by the pivotal movement of the hook 57, the cover 53 is pushed rightward from the state in FIG. 3, thereby tilting the cover 53 rightward from the side wall 1*c* as the engaged state of the hook 57 with the engaged portion 55 is released.

In this arrangement, in the case where the DSC transport unit 4 is not mounted on the machine main body 1, merely opening the cover 51 allows the first route 32 and the second route 33 simultaneously accessible to outside of the machine main body 1 to remove a jammed sheet. Accordingly, even if a sheet is jammed near the switching members 35, 36, e.g., when a lead end of the sheet is about to come out of the main route 31, which makes it difficult for an operator to judge, from outside of the machine main body 1, which cover should be opened to remove the jammed sheet, the first route 32 and the second route 33 are simultaneously accessible to the operator by merely opening the cover 51. Thereby, the operator can promptly recognize the position of the jammed sheet and quickly remove the jammed sheet.

In the case where the DSC transport unit 4 is mounted on the machine main body 1, the cover 53 is obstructed from being opened due to the existence of the DSC transport unit 4. Accordingly, in the case where a sheet is jammed near the switching members 35, 36 in the mounted state of the DSC transport unit 4, the jammed sheet is removed by opening the cover 51 or detaching the DSC transport unit 4 from the machine main body 1 according to needs.

Since the copying machine A1 is so constructed as to open the cover 53 in association with opening of the cover 51, there has to be considered a possibility that the cover 53 may be unintentionally left slightly opened in association with opening of the cover 51 in a state that the DSC transport unit 4 is mounted on the machine main body 1. Such slightly opened state of the cover 53 leads to a sheet transfer failure.

Specifically, in most cases, there is defined the small clearance h (see FIG. 2) between the machine main body 1 and the DSC transport unit 4 when the DSC transport unit 4 is mounted on the machine main body 1. The cover 53 is allowed to open in association with opening of the cover 51 within the space corresponding to the clearance h. Accordingly, it is likely that the cover 53 may be left slightly opened after closing the cover 51. If a roller or its equivalent is mounted on the cover 53, it is likely that the slightly opened state of the cover 53 disengage gears that are supposed to be in mesh each other to transmit the drive power to the roller on the cover 53 after closing the cover 51, thus resulting in a sheet transport failure.

To eliminate the above problem, the copying machine A1 is constructed such that the center of gravity 0 of the cover 53 along the horizontal direction H is located on the side of the machine main body 1 from the rotational center 54*c* of pivot shaft 54 even if the cover 53 is opened at the maximum range of the clearance h so that counterclockwise moment force around the rotational center 54*c* always acts on the cover 53. This arrangement enables the cover 53 to securely return toward a closed state by the counterclockwise moment force acting on the cover 53 due to its own weight even if the cover 53 is opened in association with opening of the cover 51, as long as the cover 53 opens in the clockwise direction within the maximum range of the clearance h. Then, the hook 57 returns to an engaged state with the engaged portion 55 due to a biasing force of the torsion spring 59, and then the cover 53 is held in a completely closed state. Accordingly, even if the cover 53 is unintentionally opened in association with opening of the cover 51 in a state that the DSC transport unit 4 is mounted on the machine main body 1, there can be eliminated a possibility that the cover 53 is left slightly opened. Therefore, it is possible to effectively prevent a transport failure due to the slightly opened state of the cover 53.

In the above arrangement, when an operator opens the cover 51, an external force applied by the operator to open up the cover 51 causes the projection 51*a* to press the hook 57 downward so as to disengage the hook 57 from the engaged portion 55 while indirectly transmitting a torque to rotate the cover 53 in the opened direction via the hook 57. Accordingly, opening the cover 51, when the DSC transport unit 4 is mounted on the machine main body 1, may cause a breakage or damage of the cover 53 if no adequate measure was taken as described in the following.

The cover 53 is allowed to tilt within the clearance h when opening the cover 51. When the cover 51 needs to be further opened, however, the tilting of the cover 53 is obstructed by the DSC transport unit 4. In fact, forcing the cover 53 to open beyond the clearance h would exert an undesirable force to the hook 57, the cover 53 and its peripheral parts, resulting in a breakage or damage of the hook 57, the cover 53 and the peripheral parts.

The machine main body 1 is constructed such that the contact portion 57*a* of the hook 57 in contact with the projection 51*a* is formed into a tapered shape, and the hook 57 is biased upward by a biasing force of the torsion spring 59. However, in the course of opening the cover 51, the hook 57 can be pressed downward due to a pressing contact with the projection 51*a*; this angular displacement of the hook 57 allows that the pressing force is absorbed by the torsion spring 59. It should be understood that when the cover, that is already at the position to make contact with the DSC transport unit 4, is pressed further against the DSC transport unit 4 due to the moment force transmitted from the projection 51*a* through the contact portion 57*a*, the hook 57 is simply further displaced in the counterclockwise direction, enabling to cut the force transmission to the cover 53. Accordingly, there can be eliminated or suppressed a possibility that the cover 53 is forcefully opened beyond the clearance h when the DSC transport unit 4 is mounted on the main body 1. This way of arrangement prevents damage or breakage of the hook 57, the cover 53, and its peripheral parts.

It should be noted that the copying machine A1 is merely one of the preferred embodiments of the present invention, and the following modifications and alterations can be applied to the present invention.

In the above embodiment, the cover 53 is so constructed as to be closed by the moment force due to its own weight because of the location of the center of gravity 0 of the cover 53 within the clearance h of the cover 53 in a state that the DSC transport unit 4 is mounted on the machine main body 1.

Alternatively, the cover 53 can be constructed such that it returns to a closed state utilizing a biasing force of the torsion spring 59 which is used to engage the hook 57 with the engaged portion 55. Furthermore, a spring or its equivalent may be added in the machine main body 1 to urge the cover 53 toward the opened direction. In this modification, when the engaged state of the hook 57 is released accompanied by opening of the cover 51, the cover 53 is opened by a biasing force of the spring. When the cover 51 is set to a closed state, on the other hand, the cover 53 is restored to a closed state by the biasing force of the torsion spring 59 against the biasing force of the spring. In this modification, there is no need of designing the machine main body considering the position of the center of gravity of the cover 53, thereby allowing more freedom in designing and engineering.

As an alteration, the hook 57 and the engaged portion 55 may be omitted, and the cover 53 may be opened by directly pushing the cover 53 by the projection 51*a* of the cover 51. In this alteration, however, since the cover 53 is held in a closed state merely by the weight thereof, it is likely that the cover 53 may be easily opened. Accordingly, there should be taken countermeasures such as providing a magnet on the side of the machine main body 1 to magnetically attract the cover 53 to the machine main body 1. This arrangement stably holds the closed state of the cover 53.

In the above alteration, however, since the cover 53 is directly pushed by the projection 51*a*, there may be a possibility that an external force (opening force) is instantaneously transmitted to the cover 53 and tries to open the cover 53 beyond the clearance h, thereby damaging or breaking the cover 53 due to an abrupt collision with the DSC transport unit 4. In this case, an elastic member (cushion member) may be interposed between the projection 51*a* and the cover 53 to absorb the pushing force of the projection 51*a* so as to prevent the damage or breakage of the cover 53.

In the foregoing embodiment, even if a large external force is exerted to the cover 51 which may open the cover 53 beyond the clearance h, the hook 57 is pivotally shifted downward against the biasing force of the torsion spring 59, thereby absorbing the pressing force of the projection 51*a* by the torsion spring 59 so as not to directly transmit the external force to the cover 53. Namely, the hook 57 and the torsion spring 59 function as the elastic member (cushion member).

In the above embodiment, the cover 53 provided to close the first route 32 is opened in association with opening of the cover 51 provided to closed the second route 33. As an altered form, in the case where the image forming apparatus is provided with a number of transport routes more than the first and the second routes and a cover is individually mounted to the apparatus main body to open the transport routes, it may be preferable to construct the image forming apparatus such that opening the cover 51 causes the covers including the cover 53 to be opened in association therewith. Alternatively, the cover 53 may be opened when the cover other than the cover 51 is opened.

In the aforementioned embodiment, the cover 53 is allowed to be temporarily slightly opened within the clearance h in association with opening of the cover 51 when the DSC transport unit 4 is mounted on the machine main body 1, and closed when the cover 51 is closed. Alternatively, the cover 53 may be set in a completely closed state regardless of opening/closing of the cover 51 when the DSC transport unit 4 is mounted. At any rate, this invention is applied to any arrangement as far as the cover 53 is substantially kept in a closed state regardless of opening/closing of the cover 51 when the DSC transport unit 4 is mounted on the machine main body 1.

The copying machine A1 has been described as an embodiment of the present invention. An image forming apparatus such as a printer other than the copying machine A1 is also applied to the present invention.

In the above embodiment, the DSC transport unit 4 is used for a double side copying or a joint copying. Namely, in the embodiment, a sheet after one side copying is transported to the imaging assembly 16 via the DSC transport unit 4 without stacking. The present invention is applicable to an image forming apparatus such as a copying machine in which sheets after one side copying are temporarily stacked on an intermediate tray and then fed to the imaging assembly again from the intermediate tray one after another for a double side copying or a joint copying.

Also, as an altered form, in place of the DSC transport unit 4, the external device may be a finisher or a sorter according to designer's choice.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

a main body;

a first transport route for guiding a sheet in a certain direction and a second transport route for guiding the sheet toward another direction different from the certain direction; a route changer for selectively changing the transport route between the first transport route and the second transport route;

a first cover and a second cover openably mounted on the main body to respectively render the first transport route and the second transport route accessible from outside of the main body when set in an opened state; and an operative mechanism for opening the first cover in association with opening of the second cover.

2. The image forming apparatus according to claim 1, wherein the operative mechanism is provided between the first cover and the main body, and includes a locking means for locking a closed state of the first cover when engaged with the main body and a lock releasing means for releasing the locked state of the first cover in association with opening of the second cover.

3. The image forming apparatus according to claim 2, wherein the locking means has an engaged portion provided on the main body and a hook provided on the first cover to be engaged with the engaged portion, the hook is formed with a contact portion, and the lock releasing means is provided on the second cover and has a contact portion rendered into pressing contact with the contact portion of the hook in association with opening of the second cover to release the locked state of the first cover.

4. The image forming apparatus according to claim 3, wherein the contact portion of the hook is formed into such a tapered shape as to tilt the first cover toward the opened state when coming into pressing contact with the contact portion of the lock releasing means.

5. The image forming apparatus according to claim 4, wherein the first cover is tilted to the opened state by its own weight when the first cover is tilted more than a predetermined angle from the closed state.

6. The image forming apparatus according to claim 3, wherein the locking means includes a bias means for urging the hook toward such a direction as to hold the engaged portion of the hook.

7. The image forming apparatus according to claim 2, further comprising a bias means for urging the first cover toward the opened state.

8. The image forming apparatus according to claim 1, wherein the main body has a side wall for mounting an external device, and the first cover constitutes part of the side wall when set in a closed state and is kept in a substantially closed state when the external device is mounted on the main body regardless of opening of the second cover.

9. The image forming apparatus according to claim 8, wherein the first cover is pivotally supported on the main body about a horizontal shaft provided on the main body and has a center of gravity thereof always on the side of the main body from an axis of the horizontal shaft when the external device is mounted on the main body.

10. The image forming apparatus according to claim 8, wherein the operative mechanism is elastically deformable to elastically press the first cover toward the opened state in association with opening of the second cover.

11. The image forming apparatus according to claim 8, further comprising a fixing means for fixing a toner image onto the sheet that has been transported in the certain direction and a first and second discharge portion, positioned after the fixing means for discharging the sheet outside the main body, wherein the first transport route is used to discharge the sheet toward the first discharge portion, the second transport route is used to discharge the sheet toward the second discharge portion, and the first transport route is used to guide the sheet to the external device via the first discharge portion when the external device is mounted on the main body.

12. The image forming apparatus according to claim 11, further comprising an imaging means provided in the main body for transferring the toner image onto the sheet and for transporting the sheet to the fixing means, an inlet formed in the main body to allow the sheet to be guided toward the imaging means from outside the main body, and a sheet circulating route provided in the external device to guide the sheet via the first discharge portion to the inlet.

* * * * *